United States Patent [19]

Meisels

[11] Patent Number: 4,980,931

[45] Date of Patent: Jan. 1, 1991

[54] SELF STERILIZING TOILET SEAT

[76] Inventor: Chaskel Meisels, 1415 - 46th St., Brooklyn, N.Y. 11204

[21] Appl. No.: 401,928

[22] Filed: Sep. 1, 1989

[51] Int. Cl.[5] ..... A47K 13/00

[52] U.S. Cl. ..... 4/233; 4/229

[58] Field of Search ..... 4/222, 227, 228, 229, 4/230, 231, 232, 233, 217

[56] References Cited

U.S. PATENT DOCUMENTS

| | | | |
|---|---|---|---|
| 1,236,902 | 8/1917 | Bowen et al. | 4/233 |
| 2,164,320 | 7/1939 | Groeniger | 4/217 |
| 3,916,459 | 11/1975 | Ivancevic | 4/217 |
| 4,063,316 | 12/1977 | Hünninghaus | 4/233 |
| 4,087,868 | 5/1978 | Gentz | 4/217 |
| 4,262,372 | 4/1981 | Ryder | 4/222 |
| 4,370,764 | 2/1983 | Ando et al. | 4/420.4 |
| 4,551,867 | 11/1985 | Gurevich et al. | 4/420.4 |
| 4,670,917 | 6/1987 | Kuo | 4/443 |

FOREIGN PATENT DOCUMENTS

| | | | |
|---|---|---|---|
| 2214368 | 10/1972 | Fed. Rep. of Germany | 4/229 |
| 2907754 | 9/1980 | Fed. Rep. of Germany | 4/233 |
| 0083870 | 7/1935 | Sweden | 4/233 |
| 0808080 | 3/1981 | U.S.S.R. | 4/229 |

*Primary Examiner*—Henry J. Recla
*Assistant Examiner*—Edward C. Donovan
*Attorney, Agent, or Firm*—Richard L. Miller

[57] ABSTRACT

A self sterilizing toilet seat is provided that includes a built-in mechanism in which detergent, water and air can respectively wash and dry the toilet seat. The built-in mechanism is so constructed that it can only operated when the toilet seat is placed in a down position onto a rim of a toilet bowl.

2 Claims, 1 Drawing Sheet

10
12
2
18
14
16
24
22
56
52
26
54
30
54
56
3
36
52
28
34
40
38
WATER
42
46
32
44
48
50
2
4
26
64
36
54
30
62
56
66
52
60
4
58

56
62
60, 62
26
36
52
54
66

10
18
22
12
24
20
14
16

SELF STERILIZING TOILET SEAT

BACKGROUND OF THE INVENTION

The instant invention relates generally to washing devices and more specifically it relates to a self sterilizing toilet seat.

Numerous washing devices have been provided in the prior art that are adapted to be used in conjunction with toilet bowls to wash the anus and genitals for hygiene purposes. For example, U.S. Pat. Nos. 4,370,764 to Ando et al, 4,551,867 to Gurevich et al and 4,670,917 to Kuo all are illustrative of such prior art. While these units may be suitable for the particular purpose to which they address, they would not be as suitable for the purpose of the present invention as hereafter described.

SUMMARY OF THE INVENTION

A primary object of the present invention is to provide a self sterilizing toilet seat that will overcome the shortcomings of the prior art devices.

Another object is to provide a self sterilizing toilet seat that includes a built-in mechanism so that detergent, water and air can respectively wash and dry the toilet seat.

An additional object is to provide a self sterilizing toilet seat in which the built-in mechanism can only operate when the toilet seat is placed in a down position onto the rim of the toilet bowl.

A further object is to provide a self sterilizing toilet seat that is simple and easy to use.

A still further object is to provide a self sterilizing toilet seat that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figures 1, 2, 3, 4:
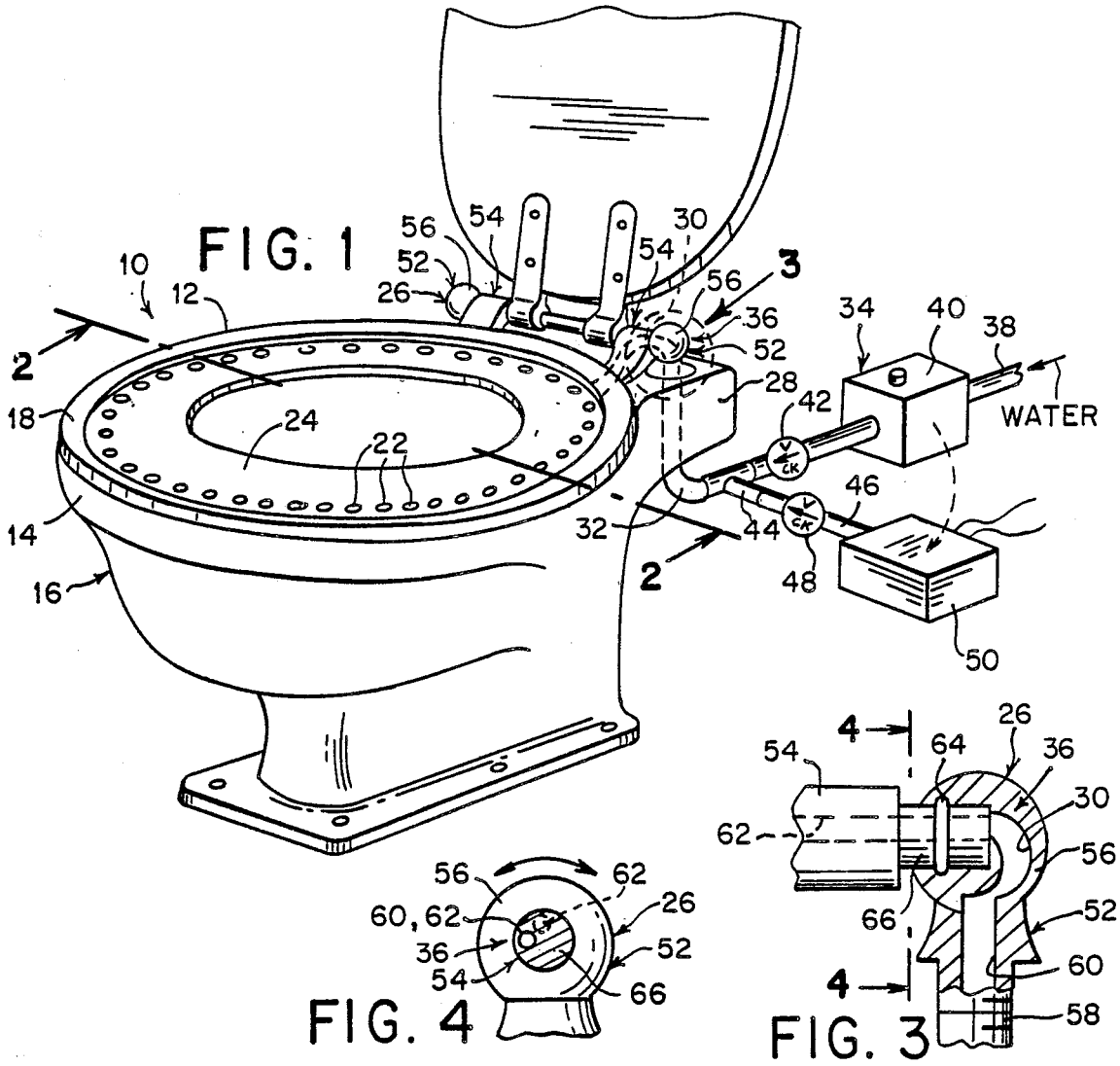
FIG. 1 is a perspective view of a toilet with the instant invention installed thereon.
FIG. 2 is a cross sectional view taken along line 2—2 in FIG. 1, showing the apertures in the toilet seat so that detergent, water and air can respectively wash and dry the seat.
FIG. 3 is and enlarged view as indicated by arrow 3 in FIG. 1 of the toilet hinge mechanism.
FIG. 4 is a cross sectional view along line 4—4 in FIG. 3.

Turning now descriptively to the drawings, in which like reference characters denote like elements throughout the several views, FIG. 1 and 2 illustrates a self sterilizing toilet seat system 10 consisting of a toilet seat 12 to be disposed on a rim 14 of a standard toilet bowl 16. The toilet seat 12 has an upper flange 18 around its periphery and an annular conduit 20 therein with a plurality of spaced apertures 22 extending from the conduit 20 to an inwardly inclined upper surface 24 of the toilet seat 12. A hinge assemble 26 is on the toilet seat 12 for mounting into rear portion 28 of the toilet bowl 16. The hinge assemble 26 has a passageway 30 therethrough fluidly connected to the conduit 20 in the toilet seat 12. A delivery tube 32 is fluidly connected to the passageway 30 in the hinge assemble 26.

A mechanism 34 is provided for respectively supplying detergent, water and warm air through the delivery tube 32 so as to wash and dry the inwardly inclined upper surface 24 of the toilet seat 12.

Another mechanism 36 is provided within the hinge assembly 26, for allowing the supplying mechanism 34 to only operate when the toilet seat 12 is placed in a down position onto the rim 14 of the toilet bowl 16.

The supplying mechanism 34 includes a water feed line 38 connecting the delivery tube 32 to a source of water and is adapted to conduct water therethrough. A dispenser 40 is provided along the water feed line 38 so as to discharge detergent into the water going into the delivery tube 32 to wash the inwardly inclined upper surface 24 of the toilet seat 12. A first check valve 42 is provided along the water feed line 38 between the dispenser 40 and the delivery tube 32, so as to prevent the back flow of air. A T-fitting 44 is connected to the delivery tube 32 before the first check value 42. An air feed line 46 is connected to the T-fitting 44. A second check valve 48 is provided along the air feed line 46, so as to prevent the back flow of water. An air blower 50 is connected to end of the air feed line 46 so as to discharge warm air into the delivery tube 32 to dry the inwardly inclined upper surface 24 of the toilet seat 12 respectively after operation of the dispenser 40.

The hinge assembly 26 includes a pair of stanchions 52 and a pair of stub shafts 54. Each stanchion 52 has an enlarged spherical head 56 and a threaded post 58 which mount into the rear portion 28 of the toilet bowl 16. Each stub shaft 54 is connected to the toilet seat 12 and is pivotally engaged in a cavity in the enlarged spherical head 56 of one of the stanchions 52.

As best shown in FIG. 3, a passageway 30 in the hinge assembly 26 includes one stanchion 52 having a passage way 60 therethrough which is fluidly connected to the delivery tube 32. One stub shaft 54 has bore 62 therethrough which is fluidly connected to the conduit 20 in the toilet seat 12 and is pivotally engaged with the enlarged spherical head 56 of the stanchion 52 having the passage way 60. An O-ring sealing gasket 64 is provided on pivoting portion 66 of the one stub shaft 54 having the bore 62, in the enlarged spherical head 56 of the stanchion 52 having the passage way 60 so as to prevent leakage therefrom.

The operating mechanism 36 includes the passage way 60 in the stanchion 52 and the bore 62 in the stub shaft 54 being offset from the center axis. When the toilet seat 12 is placed in a down position onto the rim 14 of the toilet bowl the bore 62 and the passage way 60 are aligned as shown in FIG. 4. When the toilet seat 12 is placed in an up position away from the rim 14 of the toilet bowl 16, the bore 62 and the passage way 60 out of alignment.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A self sterilizing toilet seat system which comprises:

(a) a toilet seat to be disposed on a rim of standard toilet bowl, said toilet seat having an upper flange around its periphery and an annular conduit therein with a plurality of spaced apertures extending from said conduit therein with said plurality of spaced apertures extending from said conduit to an inwardly inclined upper surface of said toilet seat;

(b) a hinge assembly on said toilet seat for mounting the toilet seat onto a rear portion of the toilet bowl, said hinge assembly comprising:

a pair of stanchions, each of said stanchions having an enlarged head and a threaded post which mounts onto the rear portion of the toilet bowl;

a pair of mounting arms extending from a rear of the toilet seat;

a pair of stub shafts rigidly connected to respective mounting arms and pivotally engaged in sockets formed in the heads of said stanchions;

a bore extending from an axial end of one of said stub shafts through the stub shaft and one of said mounting arms and fluidly connected to the conduit in said toilet seat;

one of said stanchions having a passageway extending therethrough into the socket at a location adjacent the axial end of the one of said stub shafts;

an O-ring sealing gasket provided on the one of said stub shafts at a location spaced from the axial end thereof in sealing engagement in a complementary annular recess formed in the stanchion socket so as to prevent leakage therefrom;

the bore in the one of said stub shafts being offset from the pivotal axis thereof so that when the toilet seat is placed in a down position into the rim of the toilet bowl, the bore and the passageway are aligned and, when said toilet seat is placed in an up position away from the rim of the toilet bowl, the bore and the passageway are unaligned;

(c) a delivery tube fluidly connected to the passageway in said one of said stanchions; and (d) means for sequentially supplying detergent, water and warm air through said delivery tube so as to wash and dry the inwardly inclined upper surface of said toilet seat.

2. A self sterilizing toilet seat system as recited in claim 1, wherein said supply means includes:

(a) a water feed line connecting said delivery tube to a source of water and adapted to conduct water therethrough;

(b) a dispenser provided along said water feed line so as to discharge detergent into the water going into said delivery tube to wash the inwardly inclined upper surface of said toilet seat;

(c) a first check valve provided along said water feed line between said dispenser and said delivery tube;

(d) a T-fitting connected to said delivery tube before said first check valve;

(e) an air feed line connected to said T-fitting;

(f) a second check valve provided along said air feed line; and (g) an air blower connected to end of said air feed line so as to discharge warm air into said delivery tube to dry the inwardly inclined upper surface of said toilet seat respectively after operation of said dispenser.

* * * * *